US005692663A

United States Patent [19]

Yang

[11] Patent Number: 5,692,663

[45] Date of Patent: Dec. 2, 1997

[54] TRIGGER STRUCTURE

[75] Inventor: Brad Yang, Taichung Hsien, Taiwan

[73] Assignee: Testo Industry Corp., Taichung Hsien, Taiwan

[21] Appl. No.: 678,643

[22] Filed: Jul. 11, 1996

[51] Int. Cl.[6] ..... B25C 1/04

[52] U.S. Cl. ..... 227/8

[58] Field of Search ..... 227/8, 130

[56] References Cited

U.S. PATENT DOCUMENTS

| | | | |
|---|---|---|---|
| 5,083,694 | 1/1992 | Lemos | 227/8 |
| 5,137,197 | 8/1992 | Bauer | 227/8 |
| 5,551,621 | 9/1996 | Vallee | 227/8 |
| 5,593,079 | 1/1997 | Mukoyama et al. | 227/8 |
| 5,597,106 | 1/1997 | Hamano et al. | 227/8 |

*Primary Examiner*—Scott A. Smith

*Attorney, Agent, or Firm*—Beveridge, DeGrandi, Weilacher & Young LLP

[57] ABSTRACT

The improved trigger structure for nailing guns includes a substantially C-shaped pin having a longer arm and a shorter arm; a trigger having two upright side plates each of which has a first lug with a pivot hole at a top end thereof for pivotally connecting the trigger to a gun body and a second lug with a pivot hole at a bottom end thereof for receiving the longer arm of the pin, and a trigger element having an upright plate body with two opposite lugs. Each side plate has a first curved indentation at a suitable position between the first lug and the second lug for mounting the shorter arm of the pin. A second curved indentation is provided at a bottom edge of each of said side plates for receiving and hence positioning the shorter arm of the pin. The shorter arm of the pin may be mounted on the first curved indentation to restrict displacement of the trigger element to put the nailing gun in a single strike mode or it may be mounted on the second curved indentation to allow free displacement of the trigger element to put the nailing gun in a continuous strike mode.

1 Claim, 5 Drawing Sheets

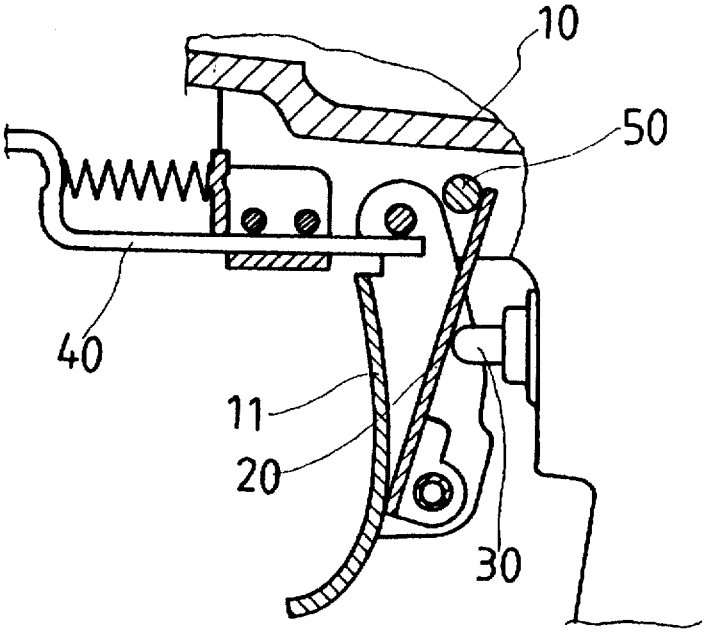
FIG. 1 (A)Prior Art
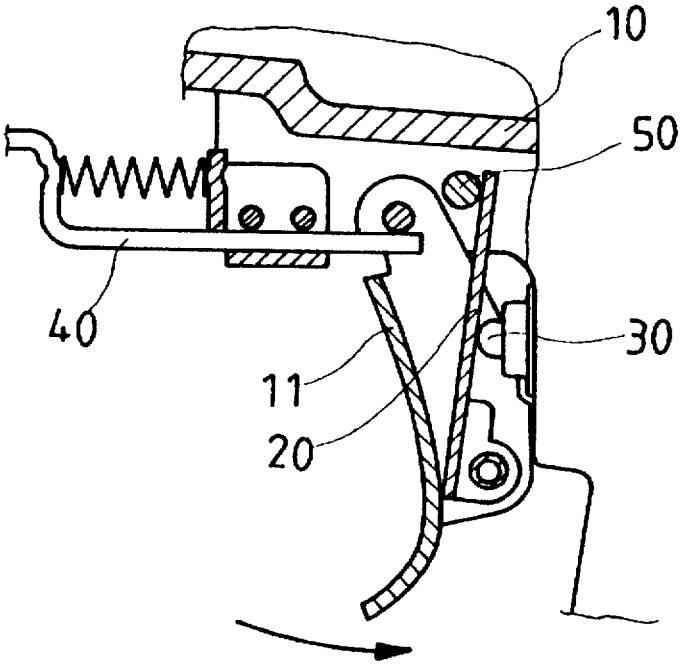
FIG. 1 (B)Prior Art

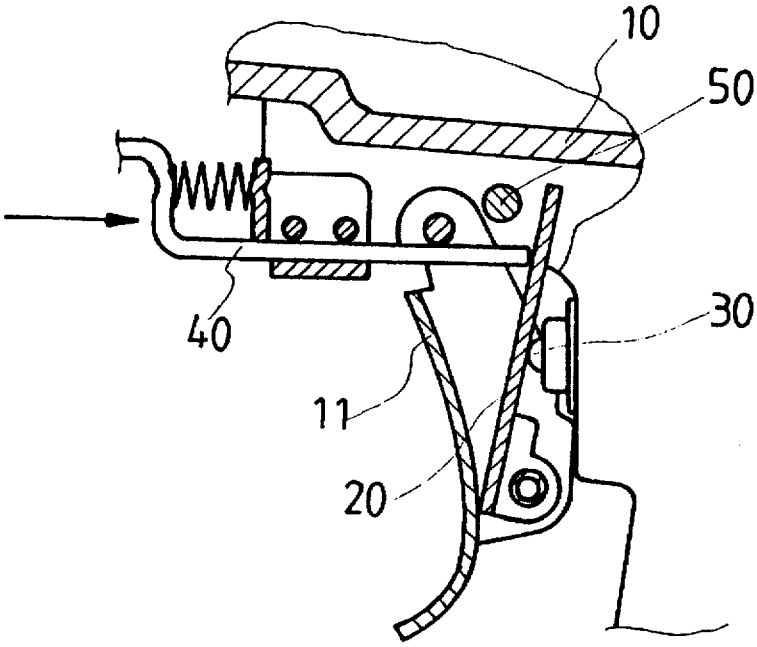
FIG. 1 (C) Prior Art
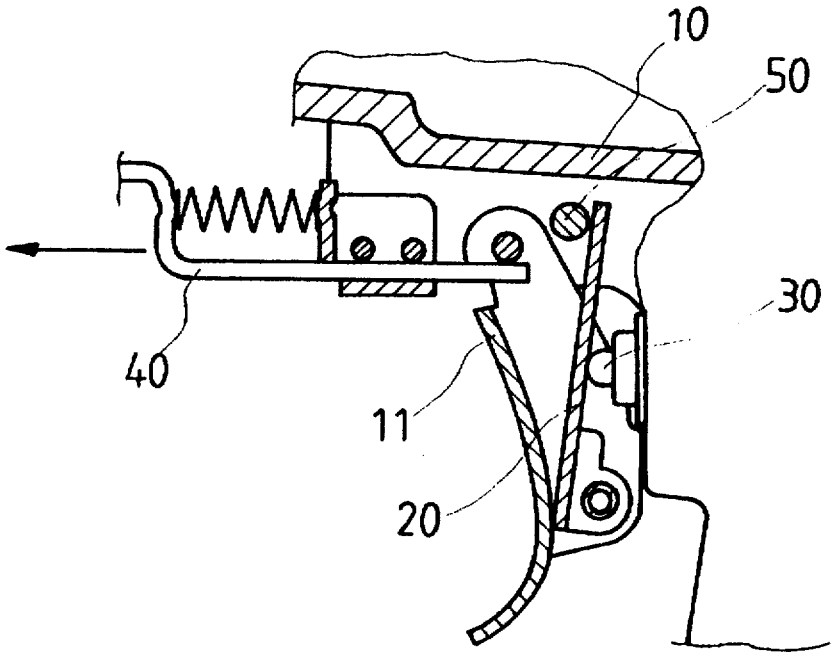
FIG. 1 (D) Prior Art

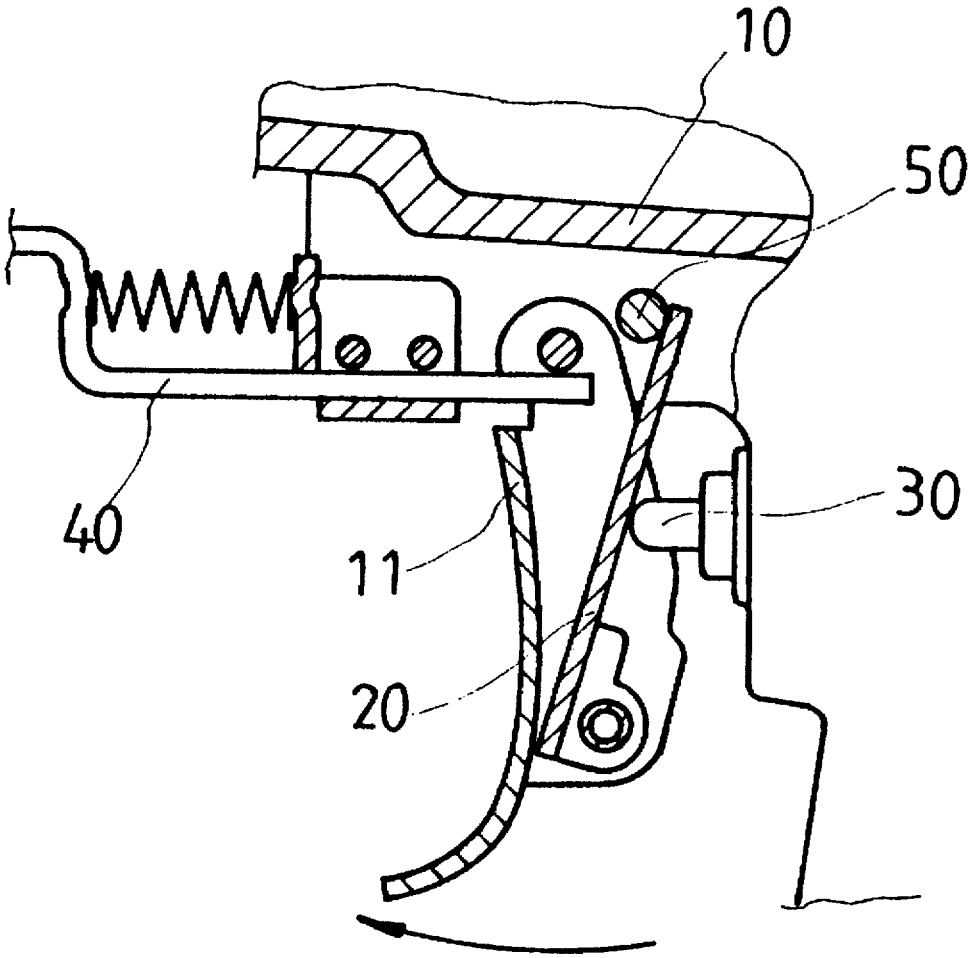
FIG. 1 (E)Prior Art

TRIGGER STRUCTURE

BACKGROUND OF THE INVENTION (a) Field of the Invention

The present invention relates generally to an improved trigger structure for nailing guns, and more particularly to an improved trigger structure in which a substantially C-shaped pin is used to allow the nailing gun to be switched between a single strike mode and a continuous strike mode in an easy and quick manner.

(b) Description of the Prior Art

Pneumatic nailing guns essentially utilized compressed air as power to instantly push a strike pin to strike a nail into a workpiece. The action of the strike pin is determined by a trigger which controls the direction of flow of the compressed air. As a general rule, in order to prevent the operator from pulling the trigger inadvertently, a safety bar is provided at the striking zone. Only when the safety bar and the trigger are pulled to push a trigger element inside the trigger will the trigger element pushes open a valve to cause the strike pin to operate. If only the trigger or the safety bar is pulled, the trigger element will not act. In use, in order to adapt to various working environments, the nails may be struck out one by one or in a series. With continuous striking, the operator has to keep on pulling the trigger with the safety bar continuously against the workpiece so that the trigger element is actuated to cause the strike pin to keep on striking nails. Under circumstances where precise striking is desired or the number of nails used is restricted, the operator has to remove the safety bar from the workpiece after each strike while releasing the trigger after each operation so as to prevent possible errors or accidents. FIGS. 1A, 1B, 1C, 1D and 1E illustrate the structure and operation of a conventional switching device for nailing guns for selectively switching the nailing gun to a single strike mode or a continuous strike mode. The switching device essentially comprises a rod-shaped pin 50 insertably disposed between a gun body 10 and a safety bar 40 for restricting the oscillating angle of a trigger element 20 so that the trigger element 20 cannot completely reset, hence enabling the nailing gun to perform single strike operations. After assembly, the relative relationship among the components is as that shown in FIG. 1A. With reference to FIG. 1B, during operation, a trigger 11 is pulled. Referring to FIG. 1C, the safety bar 40 is allowed to urge against the surface of a workpiece to push a free end of the trigger element 20 to displace to the right and push open a valve 30 so that compressed air flow changes in direction, causing a nail to be struck. As shown in FIG. 1D, when the striking operation is over and the safety bar 30 leaves the workpiece, the free end of the trigger element 20 will be retained by the pin 50 and hence positioned. Therefore, even if the trigger elements 20 continues to push against the valve 30 to stay at a striking position (i.e., it cannot displace to the left) so that the compressed air cannot change its direction of flow to allow the strike pin to reset, sustained pressure on the safety bar 40 is unable to cause the strike pin to strike. Therefore, the operator has to, as shown in FIG. 1E, release the trigger 11 so that the trigger element 20 separates from the valve 30 and the compressed air flow changes in direction, allowing the strike pin to reset to a ready position, thereby achieving the object of single strike. If the operator wants to switch the nailing gun to a continuous strike mode, he/she has to remove the pin 50 from between the trigger element 20 and the safety bar 40 and keep it in a proper place. Hence, the oscillation of the trigger element 20 is not restricted. And when the operator pulls the trigger 11, the trigger element 20 may urge open the valve 30 with the actuation of the safety bar 40 or disengages from the valve with the withdrawal of the safety bar 40. It can therefore be seen that in the prior art, the pin may be easily lost once it is removed from the nailing gun. Besides, if it is to be fitted back in place, the operator must make sure that it fits into its corresponding pin hole.

SUMMARY OF THE INVENTION

According to a primary aspect of the present invention, the improved trigger structure essentially comprises a substantially C-shaped pin having a longer arm and a shorter arm in lieu of the conventional rod-shaped pin; a trigger having two upright side plates each of which has a first lug with a pivot hole at a top end thereof for pivotally connecting the trigger to a gun body and a second lug with a pivot hole at a bottom end thereof for receiving the longer arm of said pin, and a trigger element having an upright plate body with two opposite lugs. Each side plate has a first curved indentation at a suitable position between the first lug and the second lug for mounting the shorter arm of the pin. A second curved indentation is provided at a bottom edge of each of said side plates for receiving and hence positioning the shorter arm of the pin.

BRIEF DESCRIPTION OF THE DRAWINGS

The foregoing and other features and advantages of the present invention will be more clearly understood from the following detailed description and the accompanying drawings, in which, FIGS. 1A, 1B, 1C, 1D and 1E are respective schematic views of the structure and mechanism of the conventional trigger device for nailing guns;

DETAILED DESCRIPTION OF THE PREFERRED EMBODIMENT

Figure 2:
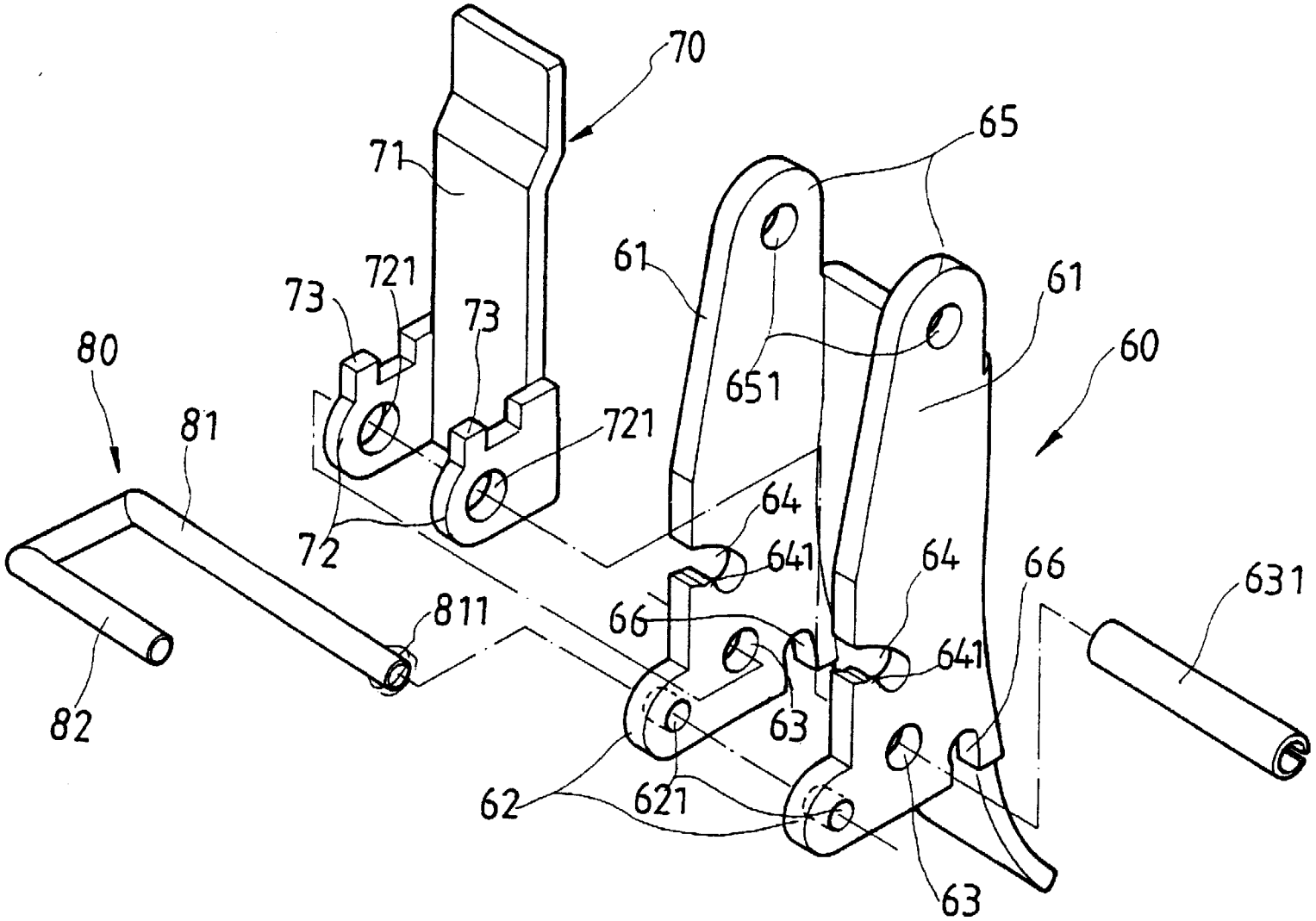
FIG. 2 is an exploded view of the improved trigger structure of the present invention.

With reference to FIG. 2, the improved trigger structure according to the present invention essentially comprises a trigger 60, a trigger element 70 disposed within the trigger 60 and a substantially C-shaped pin 80. One end of the pin 80 is a free end and has a longer arm 81 and a shorter arm 82. The trigger 60 includes two upright side plates 61, each of which is provided with a first lug 65 having pivot hole 651 at a top end thereof for pivotally connecting the trigger to the body of the nailing gun and a second lug 62 having a pivot hole 621 at a bottom end thereof for receiving the longer arm 81 of the pin 80. Each of the side plates 61 is further provided with a first first curved indentation 64 at a suitable position for mounting the shorter arm 82 of the pin 80. The first curved indentation 64 is provided with a slightly raised portion 641 at a bottom edge thereof for retaining the shorter arm 82 of the pin 80 after it is fitted into the first curved indentation 64. A pin hole 63 is further provided between the first curved indentation 64 and the second lug 62. A second curved indentation 66 is also formed at a bottom edge of each of the side plate 60.

The trigger element 70 includes an upright plate 71 having a lug 72 with a pivot hole 721 extending substantially perpendicularly to either side thereof. The lugs 72 are arranged in an opposite relationship. Each lug 72 has a projection 73 at a top side thereof.

In assembly, a shaft 631 is passed through the pin holes 63 of the side plates 61 of the trigger 60 and then the pivot holes 721 of the lugs 72 of the trigger element 70 to pivotally mount the trigger element 70 between the two side plates 61. The pin 80 may be inserted with its longer arm 81 into the pivot holes 621 of the second lugs 62 as desired. A tail portion of the longer arm 81 may be punched into a flat section 811 to prevent the pin 80 from dropping. The pin 80 may oscillate with the longer arm as its pivot so that the shorter arm 82 straddles on the two curved indentations 64, restricting the displacement of the trigger element 70.

Figure 3B:
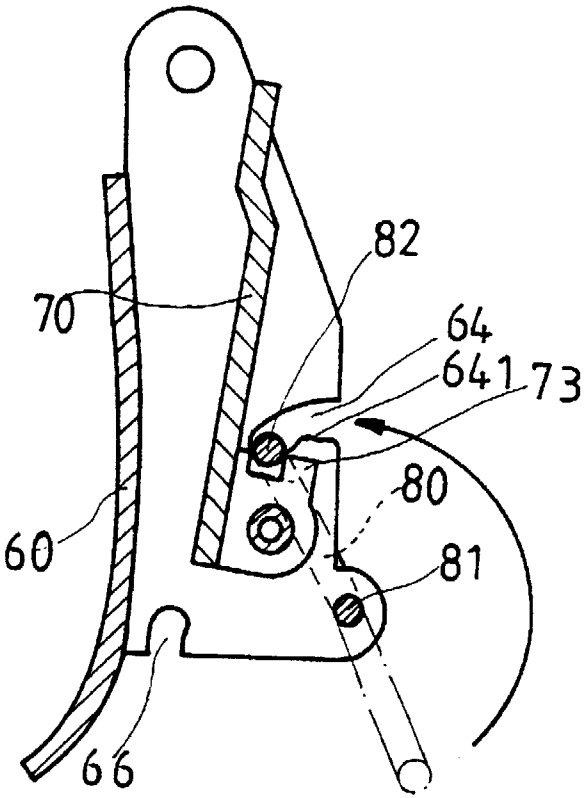
FIGS. 3A and 3B are schematic views showing the switching mechanism according to the present invention.
Figure 3:
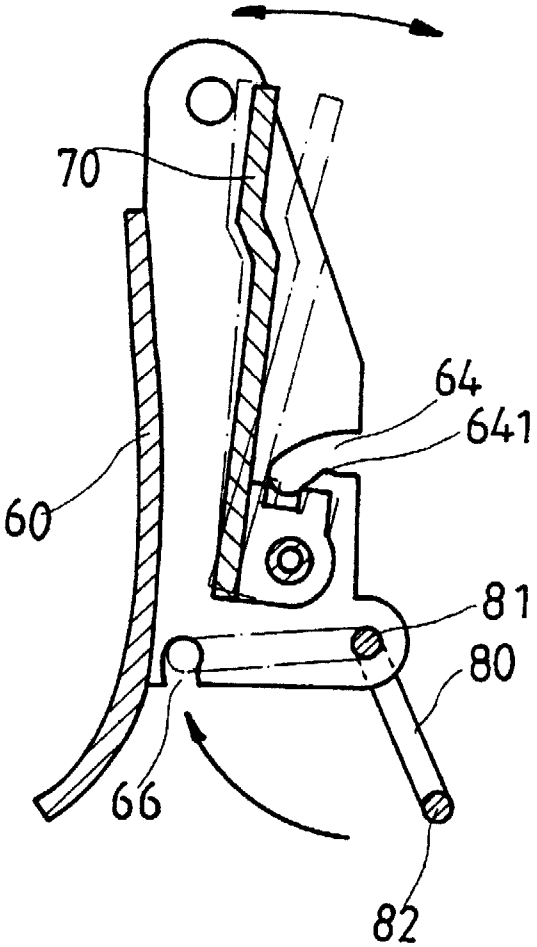

The switching operation of the present invention is illustrated in FIGS. 3A and 3B. Referring to FIG. 3A, if it is desired to maintain the nailing gun at a continuous strike mode, the shorter arm 82 of the pin may be mounted on the second curved indentation 66 so that the trigger 70 may freely displace without any restriction from the pin 80, permitting continuous striking. If it is desired to set the nailing gun to a single strike mode, referring to FIG. 3B, it is only necessary to move the shorter arm 82 of the pin 80 to fit into the first curved indentation 64, the raised portion 641 of which may further retain the shorter arm 82 therein. By means of the shorter arm 82 which fits into the first curved indentation 64 and extends between the projections 73 of the lugs 72 of the trigger element 70 and the upright plate 71, the trigger element 70 can hardly return to its original position due to the projections 73 which urge against the shorter arm 82 of the pin 80, putting the nailing gun in a single strike mode. Furthermore, by simply moving the shorter arm 82 of the pin from the first curved indentation 64, allowing free displacement of the trigger element 70, the nailing gun may be set to a continuous strike mode. The switching mechanism according to the present invention is therefore simple, quick and efficient.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved trigger structure for nailing guns whereby a nailing gun may be quickly set to a continuous strike mode or a single strike mode, said trigger structure comprising:

a substantially C-shaped pin, one end thereof being a free end, said C-shaped pin having a longer arm and a shorter arm;

a trigger having two upright side plates each of which has a first lug with a pivot hole at a top end thereof for pivotally connecting said trigger to a gun body and a second lug with a pivot hole at a bottom end thereof for receiving said longer arm of said pin, each of said side plates having a first curved indentation at a suitable position between said first lug and said second lug for mounting said shorter arm of said pin and a second curved indentation at a bottom edge thereof for receiving and hence positioning said shorter arm of said pin, said first curved indentation having a slightly raised portion at a bottom edge thereof for retaining said shorter arm of said pin, and a pin hole being provide between said first curved indentation and said second lug; and a trigger element having an upright plate body with two lugs, said lugs being disposed at both sides of said plate body opposite to each other and each having a pivot hole, each of said lugs having a projection at a top end thereof.

* * * * *